United States Patent [19]

Lum et al.

[11] Patent Number: 4,758,358

[45] Date of Patent: Jul. 19, 1988

[54] ENVIRONMENTALLY ACCEPTABLE FORGING LUBRICANTS

[75] Inventors: Andrew Lum, LaMirada; Juan Uribe, Los Angeles, both of Calif.; Ricardo Simmons, Chicago, Ill.

[73] Assignee: Van Straaten Corporation, Chicago, Ill.

[21] Appl. No.: 119,582

[22] Filed: Nov. 12, 1987

Related U.S. Application Data

[63] Continuation-in-part of Ser. No. 58,971, Jun. 8, 1987, abandoned.

[51] Int. Cl.[4] ..... C10M 141/02

[52] U.S. Cl. ..... 252/22; 252/25; 252/37; 252/40.5; 252/42; 72/42

[58] Field of Search ..... 252/22, 25, 37, 42, 252/40.5; 72/42

[56] References Cited

U.S. PATENT DOCUMENTS

| | | | |
|---|---|---|---|
| 2,176,879 | 10/1939 | Bartell | 252/22 |
| 4,119,547 | 10/1978 | Nachtman et al. | 252/29 |
| 4,155,859 | 5/1979 | Higgins | 252/22 |

FOREIGN PATENT DOCUMENTS 2185996A 8/1987 United Kingdom .

*Primary Examiner*—Jacqueline V. Howard

*Attorney, Agent, or Firm*—Neuman, Williams, Anderson & Olson

[57] ABSTRACT

A lubricant composition is disclosed which is environmentally acceptable when used with hot forging of aluminum workpieces. Said lubricant comprises a metal soap composition containing no lead plus amounts of polybutene, graphite, thickening agent, mineral oil and, optionally, aliphatic solvent.

25 Claims, No Drawings

ENVIRONMENTALLY ACCEPTABLE FORGING LUBRICANTS

This is a continuation-in-part of our application Ser. No. 058,971, filed June 8, 1987 now abandoned.

BACKGROUND OF THE INVENTION

This invention relates to a lubricant for use in hot forging of aluminum and aluminum alloy components. More specifically, this invention relates to an environmentally acceptable lubricant for use in hot forging aluminum and aluminum alloy components.

Hot forging of aluminum and aluminum alloy components requires the use of a suitable lubricant. Such lubricants are applied to the die of the forge and the workpiece to allow proper movement in the die cavities and to allow the forging process to be repeated many times in succession with or without the re-application of the lubricant. Typically, lubricants of the prior art include one or more organic lead compounds, such as lead naphthenate and lead stearate. The organic lead compounds were found to best facilitate the proper movement of the die during the forging process.

Although organic lead compounds work very well in this application, the use of lead has recently come into disfavor because of the health hazards associated with lead in the atmosphere. During the hot forging of aluminum, some of the organic lead present in the lubricant is dispersed into the atmosphere in unacceptable quantities. Local and national governmental regulatory agencies have banned the use of lead in certain industries, or have severely limited the allowable concentrations of lead in the atmosphere as reflected, for example, in Title 29 of the Code of Federal Regulations. If the use of lead in hot forging applications were to continue, it would be necessary for hot forging facilities to install very expensive exhaust and air filtration systems to lower the concentration of atmospheric lead to acceptable limits. Such exhaust and air filtering systems would not be economically feasible for most aluminum hot forging facilities.

It would therefore be desirable to have available for use in the aluminum hot forging industry an environmentally acceptable lubricant which has the same performance characteristics as lubricants of the prior art, yet without containing lead which could be dispersed into the atmosphere during the hot forging process.

SUMMARY OF THE INVENTION

It is thus one object of the invention to provide an improved hot forging lubricant.

It is another object of the invention to provide an improved hot forging lubricant which has similar performance characteristics to prior art hot forging lubricants containing organic lead.

It is yet another object of the invention to provide a hot forging lubricant which does not contain any lead which would be dispersed into the atmosphere during the hot forging process.

Other objects, advantages and novel features of the invention will be readily apparent to those skilled in the art upon review of the following specification of the invention.

In accordance with the invention, a hot forging lubricant is provided including a metal soap composition, polybutene, mineral oil, graphite, a thickening agent, and an aliphatic solvent. The metal soap composition may consist of one or more metal-organic salts wherein the metal component may be selected from the group consisting of zinc, magnesium, copper, and lithium, and wherein the organic component may be selected from the group consisting of naphthenate and fatty acids having 10–30 carbon atoms, particularly stearate and oleate. The metal soap composition is present in the lubricant in the amount of about 5–30%, the polybutene is present in the amount of about 4–15%, the graphite is present in the amount of about 3–10%, the thickening agent is present in the amount of about 2–10%, the mineral oil is present in the amount of about 0–20%, and the balance of the lubricant composition is the aliphatic solvent. The aliphatic solvent preferably has a flash point somewhere between about 100°–150° F.

The inventive lubricant advantageously contains no organic lead products. Therefore, its use in the hot forging of aluminum does not introduce any lead into the atmosphere where it could pose a health hazard to workers. Yet the inventive lubricant performs satisfactorily in the hot forging of aluminum and aluminum alloys. Furthermore, the inventive lubricant is easily blended from readily available commercial lubricant components.

DETAILED DESCRIPTION OF THE INVENTION

The instant invention is an improved forging composition including about 5–30% of a metal soap composition, about 4–15% polybutene, about 3–10% graphite, about 2–10% thickening agent, about 0–20% mineral oil, and the balance being an aliphatic solvent. It is to be understood that throughout this specification and in the claims all percentages are given in terms of weight percent regardless of whether the ingredient is solid or liquid.

The metal soap composition comprises one or more metal-organic salts. The organic component is a fatty acid having 10–30 carbon atoms, or is naphthenate. Besides the naphthenate, preferred fatty acids salts are stearate and oleate. The metal may be selected from the group consisting of zinc, magnesium, copper and lithium. Where the metal used is zinc, it has been found that where the zinc is about 1.5–2% of the entire lubricant composition, then the lubricant will have equivalent performance characteristics to prior art lubricants containing lead in the hot forging of aluminum and aluminum alloy parts. Increasing the concentration of zinc beyond 2% does not significantly improve the performance characteristics of the lubricant. Particularly preferred are the zinc stearates and naphthenates because they have a relatively higher concentration of zinc. Where the metal used is magnesium, copper or lithium, it has been found that where the metal content is 1.5–2% of the entire lubricant composition, the lubricant will have performance characteristics equivalent or slightly lower than prior art lubricants containing lead. The metal content of these soaps on a weight percent basis is significantly less than the metal content of the zinc soaps. Therefore, lubricants containing soaps of these metals are not as commercially viable as those containing zinc soaps although they may be used satisfactorily in the instant invention.

The polybutene augments the lubricating properties of the inventive composition by wetting the surfaces of the die and the workpiece to be forged. The viscosity of the polybutene may range between 600,000 and 800,000 SUS at 100° F. The higher viscosity polybutene provides superior performance characteristics in the hot forging process. Lower viscosity grades may tend to decrease the performance of the hot forging lubricant. The polybutene should also have a sufficiently high molecular weight but not so high so that the polybutene becomes solid. Generally a molecular weight of about 2,000–2,300 will provide good performance characteristics.

The graphite in the inventive lubricant composition provides a physical separation between the workpiece and the die during the forging operation. Either natural or synthetic graphite may be used satisfactorily. The choice of synthetic versus natural graphite may be made on economic considerations. Particle size of 325 mesh or finer gives superior performance. Coarser grades do not appear to coat the surfaces of the die and workpiece with the same uniformity as do the finer grades.

The mineral oil used in the lubricating composition of the instant invention may advantageously be made of treated naphthenic base stocks. While lubricants containing mineral oils of paraffinic origin permit one to produce forgings falling within acceptable dimensional tolerances, they leave a residue on the forgings which is difficult to remove. Thus, mineral oils of napthenic, as opposed to paraffinic, origin are preferred for use in the lubricants of the invention.

The conditions of the particular forging operation will determine the preferred viscosity of the mineral oil to be used. In general, higher viscosity, higher average molecular weight oils provide better metal flow and therefore easier forming and less energy consumption. Such higher viscosity oils, however, tend to produce a black smoke during the forging process. Thus, under less rigorous forging conditions one may desire to use of lower viscosity oils, and therefore reduce the generation of undesirable smoke. For example, under less severe forging conditions, mineral oil having a viscosity of 70 to 100 SUS at 100° F. may produce satisfactory forgings while avoiding the undesirable black smoke which may be produced when higher viscosity mineral oils are used in the lubricant. A much higher viscosity grade however, such as one having a viscosity of from about 1200 SUS up to about 8,000 to 10,000 SUS at 100° F. or higher may be necessary to produce acceptable products under more severe forging conditions, notwithstanding its tendency to produce some smoke. Insofar as the performance of the lubricant is concerned, there is no known upper limit on the viscosity of the mineral oil component other than that imposed by the commercial availability of acceptable oils having higher viscosity.

A thickening agent is desirable to maintain the graphite in the liquid suspension and to keep the suspension even. Preferred thickening agents are stearic acid, sodium stearate and mixtures of the two. The stearic acid has a lower melting temperature and is generally easier to work with in formulating the lubricant composition. The use of the thickening agent eliminates the need for the user to continually mix the product during the forging process, which mixing would otherwise be necessary to guarantee the uniformity of the lubricant composition. The thickening agent also imparts additional lubricity to the composition.

The aliphatic solvent may be odorless mineral spirits. This solvent is commercially available over a range of flash temperatures. Solvents having flash temperatures of about 100°–150° F. are suitable for this application, and solvents having flash temperatures of 105° F. and 140° F. have been found to work well.

The following examples are typical of lubricant formulations which are environmentally acceptable and which come within the scope of the present invention.

EXAMPLE I

| | |
|---|---|
| Zinc Stearate | 6% |
| Zinc Naphthenate | 6% |
| Polybutene | 6% |
| Mineral Oil (70 SUS @ 100° F.) | 5% |
| Graphite (natural) | 6% |
| Solvent (140° F. flash) | 64% |
| Stearic Acid | 4% |
| Sodium Stearate | 3% |

EXAMPLE II

| | |
|---|---|
| Zinc Naphthenate | 9% |
| Polybutene | 6% |
| Mineral Oil (1200 SUS @ 100° F.) | 20% |
| Graphite (natural) | 5% |
| Solvent (140° F. flash) | 34% |
| Solvent (105° F. flash) | 18% |
| Stearic Acid | 5% |
| Sodium Stearate | 3% |

EXAMPLE III

| | |
|---|---|
| Copper Naphthenate | 20% |
| Polybutene | 6% |
| Mineral Oil (1200 SUS @ 100° F.) | 10% |
| Graphite (natural) | 5% |
| Solvent (140° F. flash) | 52% |
| Stearic Acid | 3% |
| Sodium Stearate | 4% |

EXAMPLE IV

| | |
|---|---|
| Magnesium Stearate | 6% |
| Zinc Naphthenate | 6% |
| Polybutene | 6% |
| Mineral Oil | 6% |
| Graphite (natural) | 6% |
| Solvent (140° F. flash) | 64% |
| Stearic Acid | 4% |
| Sodium Stearate | 2% |

EXAMPLE V

| | |
|---|---|
| Zinc Naphthenate | 9% |
| Polybutene | 6% |
| Mineral Oil (10,000 SUS @ 100° F.) | 10% |
| Graphite (natural) | 5% |
| Solvent | 62% |
| Sodium Stearate | 3% |
| Stearic Acid | 5% |

The above examples were tested on a variety of hot forged aluminum articles. These ranged from very large parts, such as aluminum wheel hubs, to precision forged articles for aircraft and aerospace applications. Die temperatures varied from 400° F. to 700° F. and workpiece temperatures varied between 600° F. to 800° F. The lubricant was sprayed onto the dies and parts, and the lubricant flashed and burned cleanly. It did not produce excessive quantities of visible smoke. No excessive buildup or sticking of dies was observed. All forge dimensional tolerances were met. Overall, the performance was equivalent to that of a high performance lead based forging compound.

In some applications, it may not be feasible to spray the dies and workpiece. In those situations, it is preferable to have a formulation which can be swabbed onto these pieces. Such a formulation may comprise about 5–30% metal soap composition, about 4–15% polybutene, about 3–20% graphite, about 2–10% thickening agent, and the balance of the composition comprising mineral oil. The following example illustrates a formulation within the scope of the instant invention which is in the form of a paste rather than a sprayable liquid.

EXAMPLE VI

| | |
|---|---|
| Zinc Stearate | 6% |
| Zinc Naphthenate | 17% |
| Mineral Oil (1200 SUS @ 100° F.) | 48% |
| Polybutene | 12% |
| Graphite (natural) | 15% |
| Sodium Stearate | 2% |

The above formulation was applied by swabbing the punch and die to hot forge a large hollow aluminum shell. The results were satisfactory.

The embodiments of the invention containing the aliphatic solvent, as illustrated by Examples I–V, can be made in the following manner: a first tank is provided with a mixer and an in-process heating means. This tank is charged with all the liquid ingredients of the inventive lubricant composition with the exception of the solvent. In the case of Example I, these ingredients include the zinc naphthenate, polybutene, and mineral oil. These ingredients are heated to about 220°–250° F. with mixing until a homogeneous mixture is obtained. To this mixture are added the solid ingredients except the sodium stearate, i.e., the zinc stearate, graphite, and stearic acid. The heat is turned off, and the mixture is allowed to cool to about 180° F. with continued mixing. If the mixture reaches too low a temperature it can become too thick to handle easily. While the mixture is cooling, a second tank provided with a mixer but no heating means is charged with the aliphatic solvent, and the sodium stearate is dispersed therein. The sodium stearate will not dissolve at ambient temperatures. The contents of the first tank are then added to the second tank. The contents of the first tank must be sufficiently cool that the combined ingredients will have a temperature below the flash point of the aliphatic solvent. The solvent acts in this regard to quench the temperature of the contents of the first tank. The combined ingredients are mixed until homogeneous. The inventive lubricant composition is ready to be transferred to drums, by means of, for example, large diaphram pumps.

In the embodiment in which no aliphatic solvent is used, such as is illustrated in Example VI, the composition can be made by simply charging a tank provided with a mixer and heating means with the liquid ingredients of the composition, heating the ingredients with mixing to about 220°–250° F., mixing in the solid ingredients, and allowing the mixture to cool while mixing continues. When the composition reaches about 140°–160° F. it is ready to be transferred to other containers.

The foregoing examples are intended to be merely illustrative of the environmentally acceptable forging lubricants which are within the scope of the instant invention. These lubricants are particularly suitable for use with the hot forging of aluminum workpieces wherein the surface temperatures are generally lower than in the forging of metal such as steel. Moreover, the inventive lubricants advantageously contain no lead which would otherwise be dispersed into the atmosphere during forging and pose a potential health hazard.

It will be understood that changes or modifications may be made in the details of the present invention without departing from the spirit of the invention as defined in the following claims.

We claim:

1. A lead-free lubricant comprising from about 5% up to about 30% metal soap composition, from about 4% up to about 15% polybutene, from about 3% up to about 10% graphite, from about 2% up to about 10% thickening agent, from 0% up to about 20% mineral oil, and an aliphatic solvent having a flash point of about 100°–150° F.

2. The lubricant of claim 1 wherein said metal soap composition consists of one or more metal organic compounds wherein for each compound said metal component is selected from the group consisting of zinc, magnesium, copper and lithium and wherein said organic component is selected from the group consisting of stearate, naphthenate, and oleate.

3. The lubricant of claim 1 wherein said polybutene has a viscosity range of from about 600,000 up to about 800,000 SUS at 100° F.

4. The lubricant of claim 3 wherein said polybutene has an average molecular weight in the range of 2000 to 2300.

5. The lubricant of claim 1 wherein said graphite is 325 mesh or finer.

6. The lubricant of claim 1 wherein said thickening agent is selected from the group consisting of sodium stearate and stearic acid.

7. The lubricant of claim 1 wherein said mineral oil has a viscosity of from about 70 SUS at 100° F. up to about 10,000 SUS at 100° F.

8. The lubricant of claim 1 wherein said aliphatic solvent comprises odorless mineral spirits.

9. A led-lead-free lubricant comprising about 5–30% metal soap composition, about 4–15% polybutene, about 3–20% graphite, about 2–10% thickening agent, and the balance of the lubricant comprising mineral oil, said lubricant being in the form of a paste.

10. A composition comprising about 5% stearic acid, about 5.5% of a mineral oil having a viscosity of 1200 SUS at 100° F., about 5.5% graphite, about 11% zinc naphthenate, about 3% sodium stearate, about 6% polybutene and about 64% of an aliphatic solvent.

11. A composition comprising about 5% stearic acid, about 10% of a mineral oil having a viscosity of 10,000 SUS at 100° F., about 5% graphite, about 9% zinc naphthenate, about 3% sodium stearate, about 6% polybutene, about 18% of an aliphatic solvent having a flash point of 105° F., and about 44% of an aliphatic solvent having a flash point of 140° F.

12. A method of hot forging an aluminum or aluminum alloy article from a workpiece, said method comprising:

applying to a forging apparatus a coating of a lubricant lead-free comprising from about 5% up to about 30% metal soap composition, from about 4% up to about 15% polybutene, from about 3% up to about 10% graphite, from about 2% up to about 10% thickening agent, from 0% up to about 20% mineral oil, and an aliphatic solvent having a flash point of from about 200° F. up to about 150° F.;

inserting said workpiece into said forging apparatus; and forging said article from said workpiece.

13. A method of hot forging an aluminum or aluminum alloy article from a workpiece, said method comprising:

applying to a forging apparatus a coating of a lubricant lead-free comprising from about 5% up to about 30% metal soap composition, from about 4% up to about 15% polybutene, from about 3% up to about 10% graphite, from about 2% up to about 10% thickening agent, and the balance mineral oil, said lubricant being in the form of a paste;

inserting said workpiece into said forging apparatus; and, forging said article from said workpiece.

14. The method of claim 12, wherein said lubricant is applied to said forging apparatus by spraying.

15. The method of claim 12 wherein said metal soap composition consists of one or more metal organic compounds wherein for each compound said metal component is selected from the group consisting of zinc, magnesium, copper and lithium and wherein said organic component is selected from the group consisting of stearate, napthenate, and oleate.

16. The method of claim 12 wherein said polybutene has a viscosity range of from about 600,000 up to about 800,000 SUS at 100° F.

17. The method of claim 16 wherein said polybutene has an average molecular weight in the range of 2000 to 2300.

18. The method of claim 12 wherein said graphite is 325 mesh or finer.

19. The method of claim 12 wherein said thickening agent is selected from the group consisting of sodium stearate and stearic acid.

20. The method of claim 12 wherein said mineral oil has a viscosity of from about 70 SUS at 100° F. up to about 10,000 SUS at 100° F.

21. The method of claim 12 wherein said aliphatic solvent comprises odorless mineral spirits.

22. The method of claim 12, said lubricant comprising about 5% stearic acid, about 5.5% of mineral oil having a viscosity of 1200 SUS at 100° F., about 5.5% graphite, about 11% zinc naphthenate, about 3% sodium stearate, about 6% polybutene and about 64% of an aliphatic solvent.

23. The method of claim 12, said luburicant comprising about 5% stearic acid, about 10% of a mineral oil having a viscisity of 10,000 SUS at 100° F., about 5% graphite, about 9% zinc naphthenate, about 3% sodium stearate, about 6% polybutene, about 18% of an aliphatic solvent having a flash point of 105° F., and about 44% of an aliphatic solvent having a flash point of 140° F.

24. The method of claim 12, further comprising applying to said workpiece a coating of said lubricant.

25. The method of claim 13, further comprising applying to said workpiece a coating of said lubricant.

* * * * *

UNITED STATES PATENT AND TRADEMARK OFFICE

CERTIFICATE OF CORRECTION

PATENT NO. : 4,758,358

DATED : July 19, 1988

INVENTOR(S) : Andrew Lum, Juan Uribe, and Ricardo Simmons

It is certified that error appears in the above-identified patent and that said Letters Patent is hereby corrected as shown below:

Column 6, lines 67-68, "lubricant lead-free" should be -lead-free lubricant--.

Column 7, lines 14-15, "lubricant lead-free" should be -lead-free lubricant--.

Column 8, line 25, "vicisity" should be--viscosity--.

Signed and Sealed this

Fourteenth Day of February, 1989

*Attest:*

DONALD J. QUIGG

*Attesting Officer*

*Commissioner of Patents and Trademarks*